US007865126B2

(12) United States Patent
Matsuduki

(10) Patent No.: US 7,865,126 B2
(45) Date of Patent: Jan. 4, 2011

(54) IMAGE FORMING APPARATUS

(75) Inventor: Masato Matsuduki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 387 days.

(21) Appl. No.: 11/485,325

(22) Filed: Jul. 13, 2006

(65) Prior Publication Data

US 2007/0065199 A1 Mar. 22, 2007

(30) Foreign Application Priority Data

Sep. 16, 2005 (JP) ..... 2005-271065

(51) Int. Cl.
*G03G 15/00* (2006.01)
*B41J 15/16* (2006.01)

(52) U.S. Cl. ..... 399/384; 399/320; 400/611

(58) Field of Classification Search ..... 400/611, 400/618; 399/384, 320, 400
See application file for complete search history.

(56) References Cited

U.S. PATENT DOCUMENTS 4,232,961 A * 11/1980 Masuda ..... 399/179
5,848,345 A * 12/1998 Stemmle ..... 399/401
6,176,410 B1 * 1/2001 Ueda et al. ..... 226/4
6,741,830 B2 * 5/2004 Kinoshita et al. ..... 399/384
6,921,222 B2 * 7/2005 Ng et al. ..... 400/618
7,174,125 B2 * 2/2007 Yamasaki ..... 399/384
7,221,893 B2 * 5/2007 Nishikawa ..... 399/301
2003/0053833 A1 * 3/2003 Kinoshita et al. ..... 399/384
2003/0063175 A1 * 4/2003 Nishikawa ..... 347/104
2006/0062618 A1 * 3/2006 Kobayashi et al. ..... 399/384
2006/0196594 A1 * 9/2006 Shimizu et al. ..... 156/64

FOREIGN PATENT DOCUMENTS

JP A-07-256965 10/1995
JP A-2001-335206 12/2001
JP 2004001972 A * 1/2004

* cited by examiner

*Primary Examiner*—Daniel J Colilla
*Assistant Examiner*—Allister Primo
(74) *Attorney, Agent, or Firm*—Morgan, Lewis & Bockius LLP

(57) ABSTRACT

The present invention provides an image forming apparatus including: a drive roller; an image forming unit; a fixing unit; a sub drive roller provided at the downstream side of the fixing unit, nipping and conveying a continuous-form-paper, on which the toner image is fixed, to the downstream side, a rotational speed of the sub drive roller being changable; a buffer unit provided between the fixing unit and the sub drive roller, being able to increase or decrease a buffer amount of the continuous-form-paper according to expansion or contraction of the continuous-form-paper in the fixing unit; a detection section that detects the buffer amount of the buffer unit; and a control section that controls the rotational speed of the sub drive roller based on the detection result of the detection section such that the buffer amount of the buffer unit is kept substantially constant.

10 Claims, 5 Drawing Sheets

IMAGE FORMING APPARATUS

BACKGROUND

1. Technical Field

The present invention relates to an image forming apparatus which forms an image in continuous form paper.

2. Related Art

In the image forming apparatus in which the continuous form paper is used, tension of the continuous form paper is kept at a proper value in each portion of a conveyance path of the continuous form paper, particularly near a transfer unit which transfers a toner image formed in a photosensitive body to the continuous form paper. However, when the tension is fluctuated, sometimes poor print is generated, and conveyance failure such as paper jam is generated in the worst case. Particularly, in a full-color printer in which toner images having different colors formed in plural photosensitive bodies are superposed by sequentially transferring on the continuous form paper, it is necessary to suppress the tension fluctuation because higher accuracy is required for the conveyance of the continuous form paper.

Therefore, various configurations in which the tension is stabilized have been proposed.

A fixing device imparts thermal energy to fix an unfixed toner image to the continuous form paper. At this point, expansion and contraction are generated in the continuous form paper. Particularly the expansion and contraction occur remarkably in the case of a flash fixing method in which the unfixed toner image is fixed by flash light of a xenon lamp or the like. Thus, when the expansion and contraction are generated in fixing the unfixed toner image with the fixing device, the fluctuation in tension is generated in the continuous form paper, which results in the poor print and the conveyance failure.

In order to avoid such failures, it is necessary that the fluctuation in tension caused by the expansion and contraction of the continuous form paper in the fixing unit have no influence on the transfer unit located on the upstream side. Specifically, a drive roller which grips and conveys the continuous form paper while nipping the continuous form paper may be provided on the upstream side (between the transfer unit and the fixing unit) of the fixing unit, which allows the fluctuation in tension caused by the expansion and contraction of the continuous form paper in the fixing unit to be cut off. However, because the toner image on the continuous form paper on the upstream side (between the transfer unit and the fixing unit) of the fixing unit is the unfixed toner image, it is impossible to form the configuration in which the continuous form paper is gripped and conveyed while nipped. Therefore, it is impossible to provide the drive roller which grips and conveys the continuous form paper while nipping the continuous form paper on the upstream side of the fixing unit (between the transfer unit and the fixing unit).

That is, it is difficult that the fluctuation in tension caused by the expansion and contraction of the continuous form paper in the fixing unit has no influence on the transfer unit located on the upstream side.

SUMMARY

An image forming apparatus according to a first aspect of the invention includes: a drive roller that nips and conveys a continuous form paper to a downstream side at a predetermined speed; an image forming unit that is provided at the downstream side of the drive roller and transfers a toner image to the continuous form paper; a fixing unit that is provided at the downstream side of the image forming unit and fixes the transferred toner image to the continuous form paper; a sub drive roller that is provided at the downstream side of the fixing unit, and nips and conveys the continuous form paper, on which the toner image is fixed, to the downstream side, a rotational speed of the sub drive roller being changable; a buffer unit that is provided between the fixing unit and the sub drive roller, the buffer unit being able to increase or decrease a buffer amount of the continuous form paper according to expansion or contraction of the continuous form paper in the fixing unit; a detection section that detects the buffer amount of the buffer unit; and a control section that controls the rotational speed of the sub drive roller based on the detection result of the detection section such that the buffer amount of the buffer unit is kept substantially constant.

BRIEF DESCRIPTION OF THE DRAWINGS

Exemplary embodiment of the present invention will be described in detail with reference to the following figures, wherein:

FIG. 4A is a plan view, and FIG. 4B is a side view.

DETAILED DESCRIPTION

An image forming apparatus according to an exemplary embodiment of the invention will be described with reference to the accompanying drawings.

Figure 1:
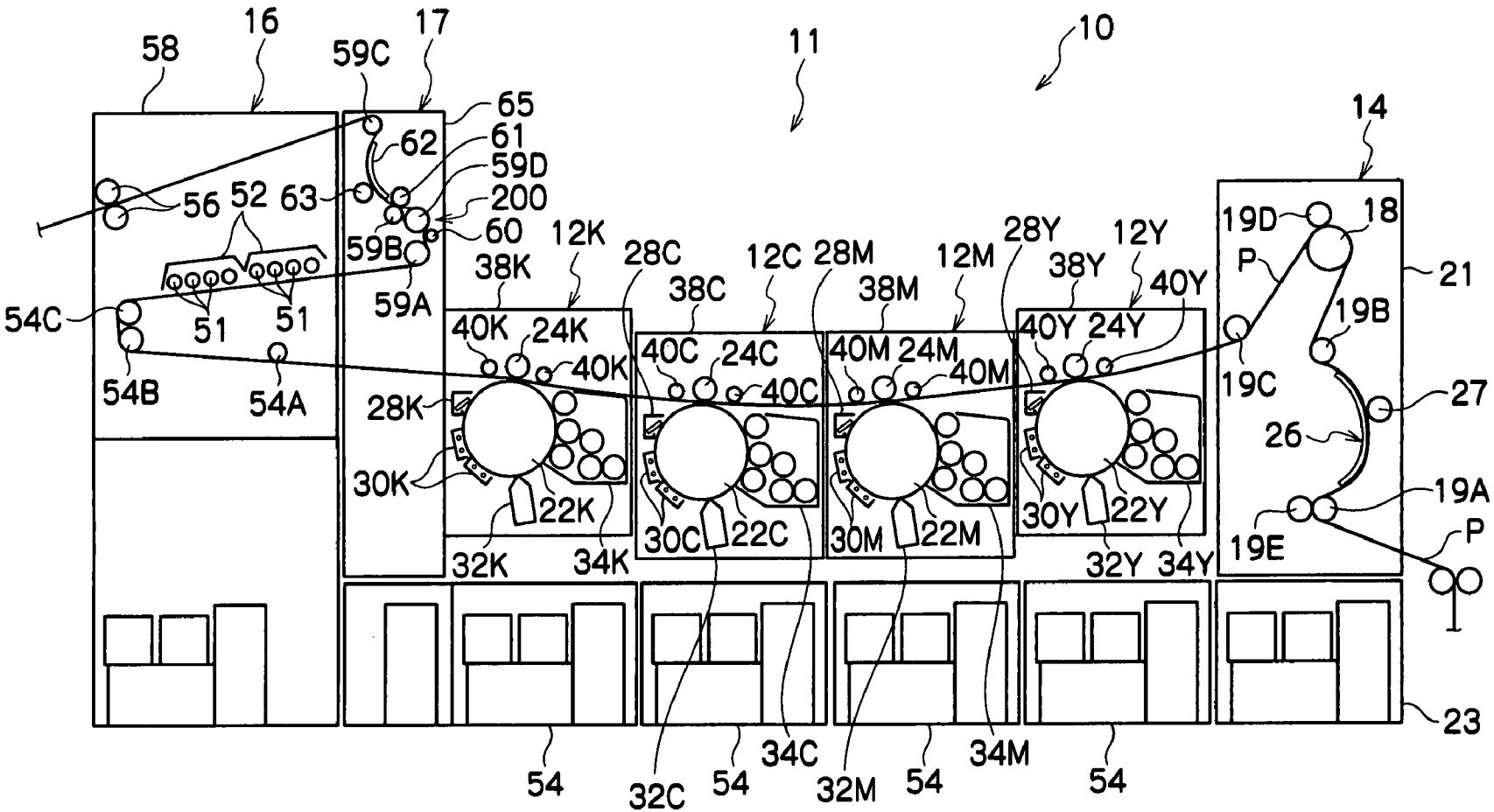
FIG. 1 is a schematic view showing a color laser printer according to an embodiment of the invention.
Figure 2:
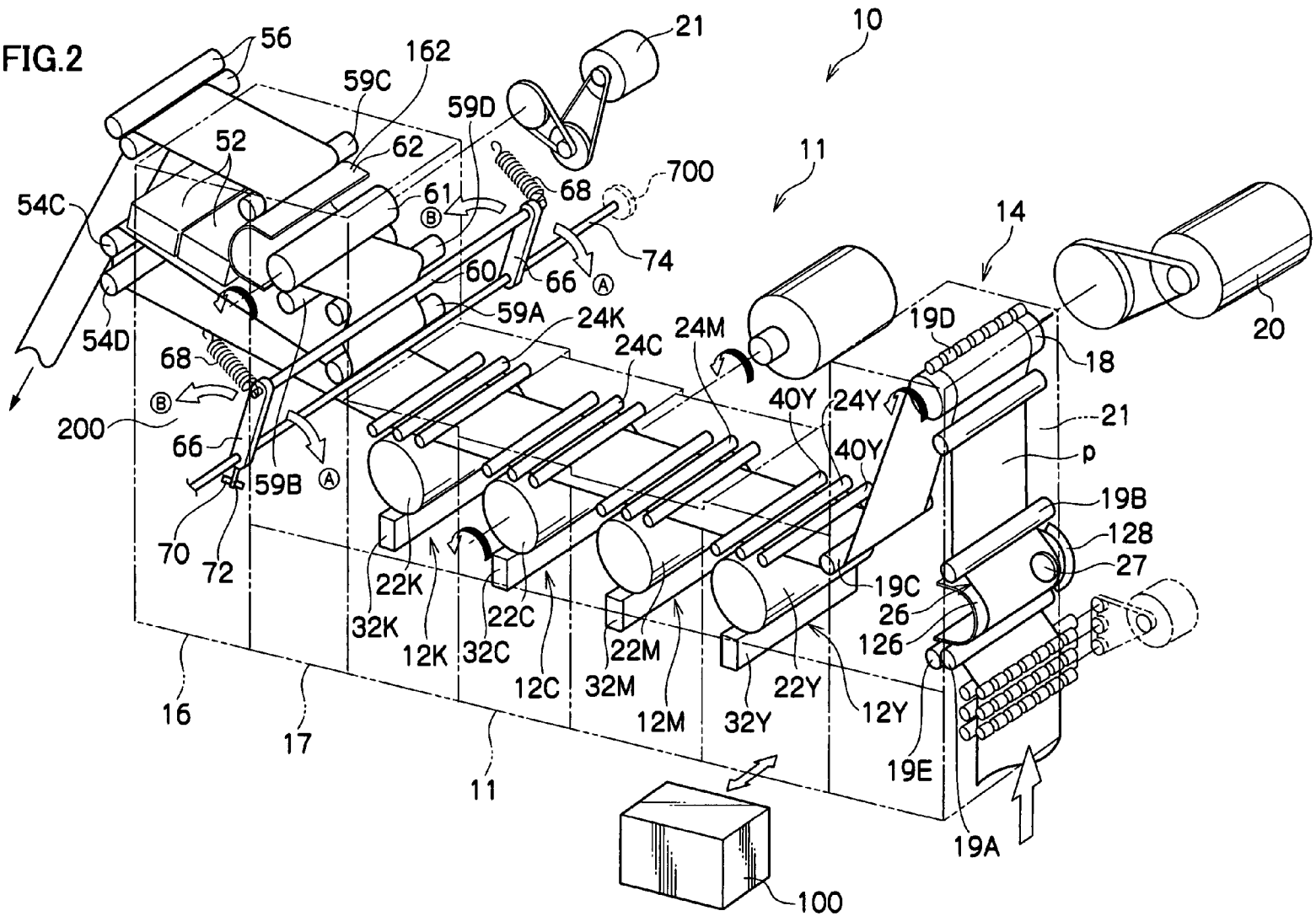
FIG. 2 is a perspective view showing the color laser printer according to the embodiment of the invention.

FIGS. 1 and 2 show a color laser printer (hereinafter referred to as printer) 10 which is of the image forming apparatus for forming an image in continuous form paper P.

In starting of printing, conveyance speed of the continuous form paper P is gradually increased, and the image formation is started after the conveyance speed reaches a predetermined speed (through-up). In ending of the printing, the conveyance speed of the continuous form paper P is gradually decreased and stopped (through-down). Therefore, the printer 10 has the configuration in which feedback conveyance can be performed. In the feedback conveyance, the continuous form paper P is conveyed in a reverse direction by an amount corresponding to the through-up and the through-down.

The printer 10 includes an image forming unit 11 which forms the image in the continuous form paper P. The image forming unit 11 includes printing units 12Y, 12M, 12C, and 12K. The printing units 12Y, 12M, 12C, and 12K form the toner images having colors of yellow (Y), magenta (M), cyan (C), and black (B) to transfer the toner images to the continuous form paper P respectively. The printing units 12Y, 12M, 12C, and 12K are arranged in the order from the upstream side in the conveyance direction of the continuous form paper P.

In the following description, Y, M, C, or K is added to the numeral in the case where Y, M, C, and K are differentiated from one another, and Y, M, C, and K are omitted in the case where Y, M, C, and K are not differentiated from one another. Sometimes the printing units 12Y, 12M, 12C, and 12K are represented by printing units 12Y to 12K.

A fixing unit 16 is provided on the downstream side of the image forming unit 11 in the conveyance direction. The fixing unit 16 fixes the unfixed toner image, transferred by the printing units 12Y to 12K, to the continuous form paper P. A paper discharge unit 17 which discharges the continuous form paper P passing through the fixing unit 16 is provided on the downstream side of the fixing unit 16 in the conveyance direction.

A paper conveyance unit 14 which conveys the continuous form paper P to the image forming unit 11 is provided on the upstream side of the image forming unit 11 in the conveyance direction.

The paper conveyance unit 14 includes a drive roller 18 about which the continuous form paper P is entrained. Idle rollers 19A and 19B about which the continuous form paper P is entrained are provided on the upstream side of the drive roller 18 of the paper conveyance unit 14 in the conveyance direction. An idle roller 19C about which the continuous form paper P is entrained is provided on the downstream side of the drive roller 18 in the conveyance direction. An idle roller 19D is pressed against the drive roller 18, and the continuous form paper P is nipped between and conveyed by the idle roller 19D and the drive roller 18.

A drive roller motor 20 (see FIG. 2) drives the drive roller 18, and a control unit 100 (see FIG. 2) controls the drive roller motor 20. The control unit 100 also controls the whole of the printer 10. The control unit 100 controls the drive roller 18 such that rotational speed of the drive roller 18 is always kept constant, and the rotational speed of the drive roller 18 is to be a reference of the conveyance speed of the continuous form paper P. The drive roller 18 is reversely rotated in the feedback conveyance.

A conveyance guide 26 is provided between the idle roller 19A and the idle roller 19B. The conveyance guide 26 includes a U-shaped curved surface 126 and a side guide 128 (see FIG. 4A). The continuous form paper P is entrained about the U-shaped curved surface 126, and the side guide 128 guides an one end portion in a width direction (orthogonal to the conveyance direction) of the continuous form paper P. A skew roller 27 which abuts on the continuous form paper P is also provided in the conveyance guide 26.

Figure 4B:
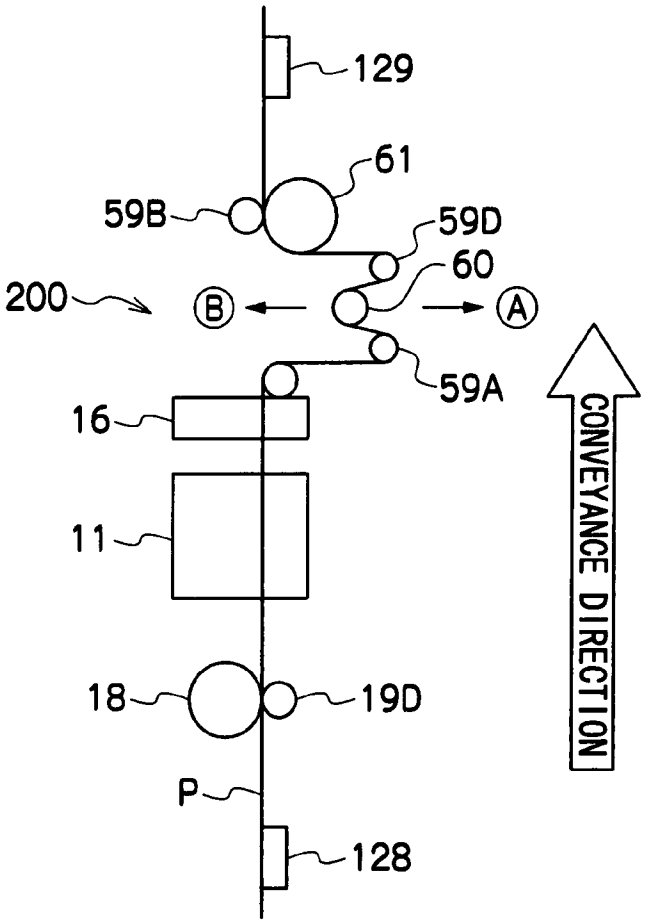
FIGS. 4A and 4B schematically show a configuration of the color laser printer according to the embodiment of the invention.
Figure 4A:
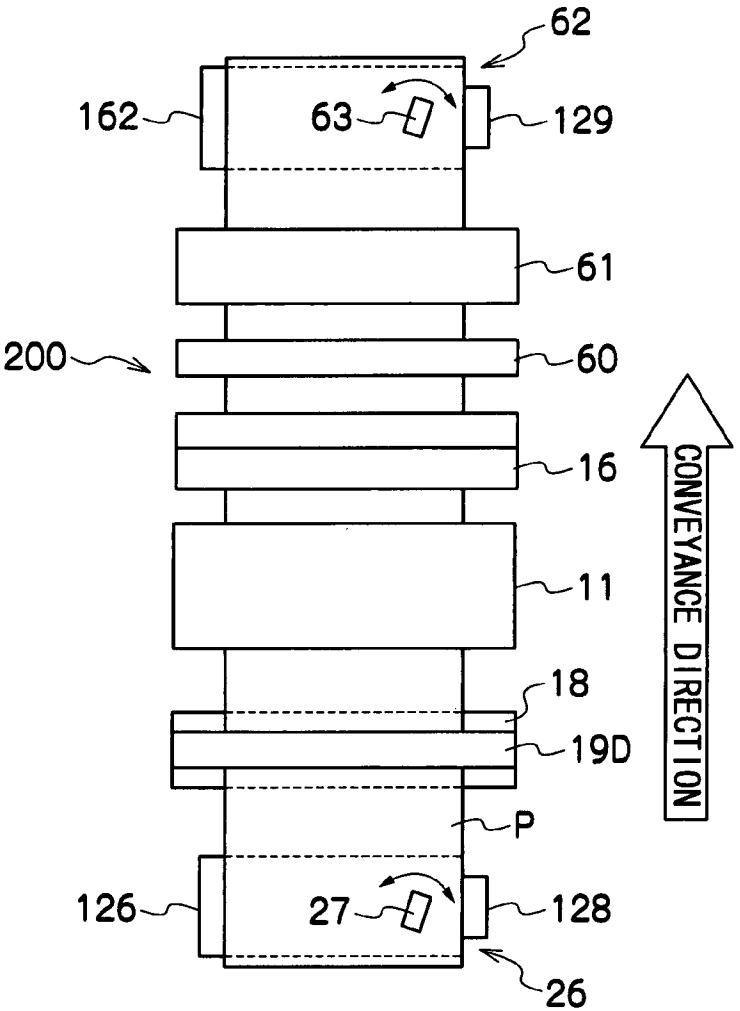

As shown in FIG. 4A, the skew roller 27 is an oblique roller whose rotating shaft is obliquely arranged to have a predetermined angle with respect to the conveyance direction of the continuous form paper P. The skew roller 27 moves the continuous form paper P toward the side of the one end portion in the width direction of the continuous form paper P. The continuous form paper P is conveyed along the side guide 128 while the one end portion in the width direction of the continuous form paper P is caused to abut on the side guide 128 of the conveyance guide 26, which allows skew of the continuous form paper P to be corrected.

The side guide 128 is set as a positional reference in the width direction of the continuous form paper P. A position in the width direction is determined by conveying the one end portion of the continuous form paper P along the side guide 128.

Figure 5:
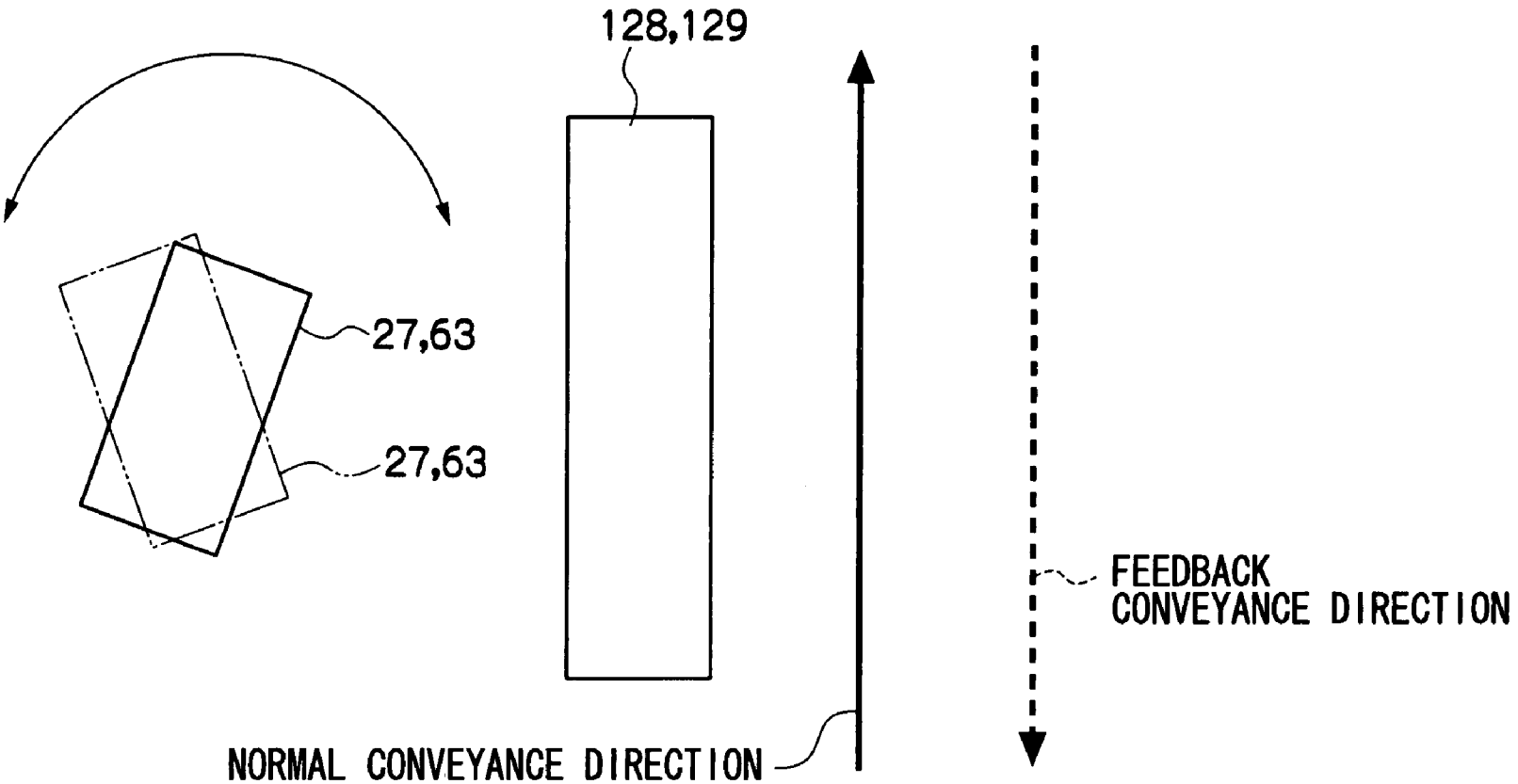
FIG. 5 is a view explaining rotation of a skew roller.

As shown in FIG. 5, the angle of the rotating shaft of the skew roller 27 (the orientation of the skew roller 27) is changed at a time of the feedback conveyance so as to bias the one end portion of the continuous form paper P to the side guide 128. Specifically, as shown in FIG. 5, when the conveyance direction is changed between the normal conveyance and the feedback conveyance, the orientation of the skew roller 27 is changed between "left" and "right" while the conveyance direction is set at the center line.

The skew roller 27 has a roller width far narrower than those of the idle rollers 19A, 19B, 19C, and 19D.

As shown in FIGS. 1 and 2, the printing units 12Y to 12K include photosensitive bodies 22 respectively. A transfer roller 24, a cleaning device 28, a charging device 30, an LED head 32, and a development device 34 are arranged around each photosensitive body 22 in the order of the rotating direction of the photosensitive body 22. For the purpose of convenience, the cleaning device 28, the charging device 30, and the development device 34 are not shown in FIG. 2.

Printing frames 38Y to 38K which support the above mentioned devices of the printing units 12Y to 12K are supported by bases 54 respectively, and the bases 54 are coupled to a base 23 which supports a paper conveyance frame 21.

The transfer rollers 24 are supported by the printing frames 38Y to 38K, and the transfer rollers 24 abut on upper surfaces of the photosensitive bodied 22 to nip and convey the continuous form paper P together with the photosensitive bodied 22. The transfer rollers 24 also transfer the toner images, formed on the photosensitive bodies 22 by the development devices 34, to the continuous form paper P.

Two guide rollers 40 are rotatably supported on the upstream side and the downstream side of the transfer roller 24. The two guide rollers 40 wrap the continuous form paper P around the photosensitive body 22 before and after the transfer, which improves stability of the transferring.

The charging device 30 charges the surface of the photosensitive body 22. The LED head 32 performs linear exposure to the surface of photosensitive body 22 to form a latent image. The development device 34 forms the toner image by causing toner to adhere onto the latent image formed on the photosensitive body 22. The cleaning device 28 removes the non-transferred, that is, residual toner, which is not transferred to the continuous form paper P but remains on the surface of the photosensitive body 22, by scraping the non-transferred.

The fixing unit 16 includes a flash fixing device 52, idle rollers 54A, 54B, and 54C, and a paper discharge roller 56. The idle rollers 54A, 54B, and 54C, the flash fixing device 52, and a paper discharge roller 56 are arranged in that order along the conveyance direction, and supported by a fixing frame 58.

The idle rollers 54A, 54B, and 54C are arranged on the backside of a print surface of the continuous form paper P, and the idle roller 54C is arranged above the idle roller 54B. Therefore, the continuous form paper P entrained about the idle rollers 54A, 54B, and 54C is conveyed while the orientation of the surface of the continuous form paper P is changed such that the print surface is orientated upward.

The flash fixing device 52 is arranged at the side of the print surface of the continuous form paper P which is conveyed while the print surface is orientated upward, and the print surface of the continuous form paper P is irradiated with infrared rays emitted from plural xenon lamps 51 when the xenon lamps 51 flash. Therefore, the unfixed toner on the continuous form paper P is heated and melted, and then the toner is solidified and fixed to the continuous form paper P.

The continuous form paper P which passes through the flash fixing device 52 is temporarily discharged from the fixing unit 16, and the continuous form paper P returns to the fixing unit 16 after passing through the paper discharge unit 17. Then, the continuous form paper P is discharged from the printer 10 by the paper discharge rollers 56.

In the paper discharge unit 17, an idle roller 59A, a buffer unit 200, a sub-drive roller 61, an idle roller 59B, a conveyance guide 62, and an idle roller 59C are arranged in that order of the conveyance direction and supported by a paper discharge frame 65. The paper discharge frame 65 is coupled to the printing frame 38K and the fixing frame 58.

The sub-drive roller 61 is arranged above the idle roller 59A, and the proceeding direction is changed upward in the continuous form paper P entrained about the idle roller 59A. The idle roller 59B is pressed against the sub-drive roller 61, and the idle roller 59B is driven by the rotation of the sub-drive roller 61. The idle roller 59B nips and conveys the continuous form paper P together with the sub-drive roller 61.

A sub-drive motor 21 (see FIG. 2) drives the sub-drive roller 61, and the control unit 100 (see FIG. 2) controls the sub-drive motor 21. The sub-drive roller 61 reversely rotated at a time of the feedback conveyance.

The buffer unit 200 is provided between the fixing unit 16 and the sub-drive roller 61. A tension imparting roller 60 and idle rollers 59A and 59D are provided in the buffer unit 200. The continuous form paper P is entrained about the tension imparting roller 60 and the idle rollers 59A and 59D. The continuous form paper P is conveyed on the tension imparting roller 60 and the idle rollers 59A and 59D in a meandering manner. In the tension imparting roller 60, both the end portions in a shaft direction are supported by one end portions of arms 66 (see FIG. 2) such that the tension imparting roller 60 can swing with respect to a rotating shaft 74 as a shaft center (see FIGS. 2 and 3) provided at the other end portions of the arms 66.

The arms 66 are biased to the side of the continuous form paper P (B side in FIG. 2) by biasing members such as tension springs 68, thus, the tension imparting roller 60 is biased to the side of the continuous form paper P. Therefore, a predetermined tension is imparted to the continuous form paper P.

Figure 3:
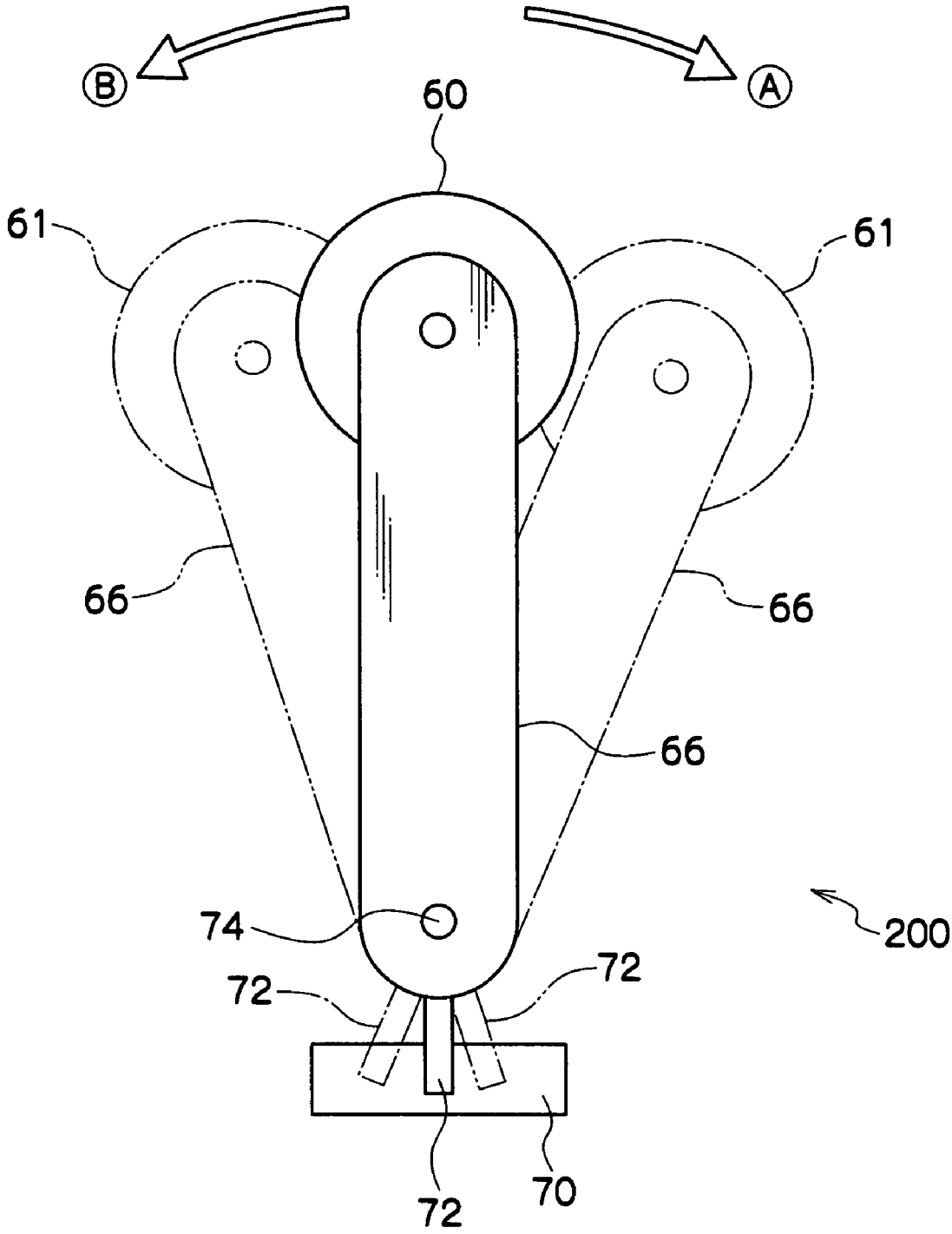
FIG. 3 schematically shows a main part of a buffer unit and shows a state in which an arm swings.

As shown in FIG. 3, the position of the tension imparting roller 60 is detected by detecting the position of a detection portion 72 with a sensor 70 such as a liner sensor or a position sensor. The detection portion 72 is projected toward the side opposite to the tension imparting roller 60 of the arm 66. The control unit 100 controls the number of revolution (rotational speed) of the sub-drive roller 61 based on the detection result such that the position of the tension imparting roller 60 is always located at a predetermined position (detail will be described later).

As shown in FIGS. 1 and 2, the conveyance guide 62 (see FIG. 1) is arranged at the downstream side of the sub-drive roller 61 in the conveyance direction. The idle roller 59C is arranged at the downstream side of the conveyance guide 62 in the conveyance direction, and the continuous form paper P is entrained about the idle roller 59C. The proceeding direction of the continuous form paper P is changed toward the paper discharge roller 56 of the fixing unit 16, and the continuous form paper P is guided to the paper discharge roller 56.

As shown in FIG. 4A, similarly to the conveyance guide 26, the conveyance guide 62 includes a U-shaped curved surface 162 and a side guide 129. The continuous form paper P is entrained about the U-shaped curved surface 162, and the side guide 129 guides the one end portion in the width direction (orthogonal to the conveyance direction) of the continuous form paper P. Similarly a skew roller 63 which abuts on the continuous form paper P is provided in the conveyance guide 62. Further, as shown in FIG. 5, the angle of the rotating shaft of the skew roller 63 (the orientation of the skew roller 27) is also changed at a time of the feedback conveyance so as to bias the one end portion of the continuous form paper P to the side guide 129 (the orientation of the skew roller 63 is changed between "left" and "right" while the conveyance direction is set at the center line).

Then, a printing operation of the printer 10 will be described.

As shown in FIGS. 1 and 2, the control unit 100 causes the paper conveyance motor 20 to be rotated to convey the continuous form paper P. The control unit 100 applies a transfer bias (positive bias) to the transfer roller 24Y to transfer the yellow toner image of the photosensitive body 22Y to the continuous form paper P. Similarly the control unit 100 sequentially transfers the color toner images of the photosensitive bodies 22M, 22C, 22K to the continuous form paper P to form the full-color toner image in which the color toner images are superposed.

As described above, because the desired tension is applied to the continuous form paper P by the tension imparting roller 60 of the buffer unit 200, the continuous form paper P is stably conveyed to perform the good transfer.

The control unit 100 causes the flash lamps to emit the infrared ray, when a front end of a region of the unfixed full-color toner image in which the yellow, cyan, magenta, and black toner images are superposed is conveyed at an entrance of an infrared irradiation area of the flash fixing device 52.

The unfixed full-color toner image on the continuous form paper P is heated and melted with the infrared ray emitted from the flash lamps when passing through the infrared irradiation area of the flash fixing device 52, and the full-color toner image is solidified and fixed to the continuous form paper P after passing through the infrared irradiation area. The continuous form paper P to which the full-color image is fixed is guided to the paper discharge roller 56 after passing through the paper discharge unit 17.

FIGS. 4A and 4B schematically show the whole configuration of the printer 10. In the following description, "upstream" and "downstream" mean the "upstream" and "the downstream" with respect to the conveyance of the continuous form paper P respectively, and the "upstream" and "downstream" do not always correspond to upstream and the downstream of the arrangement.

As shown in FIGS. 4A and 4B, the image forming unit 11 is arranged at the downstream side of the drive roller 18, and the fixing unit 16 is arranged at the downstream side of the image forming unit 11. The buffer unit 200 is arranged at the downstream side of the fixing unit 16, and the sub-drive roller 61 is arranged at the downstream side of the buffer unit 200. No problem is generated even if the continuous form paper P is nipped between and conveyed by the sub-drive roller 61 and the idle roller 59B, because the full-color toner image is already fixed to the continuous form paper P by the fixing unit 16.

The conveyance guide 26 including the side guide 128 is arranged at the upstream side of the drive roller 18, and the conveyance guide 62 including the side guide 129 is arranged at the downstream side of the drive roller 61. As described above, the angles of the rotating shafts of the skew rollers 27 and 63 (the orientations of the skew rollers 27 and 63) are changed at a time of the feedback conveyance. Specifically, the orientations of the skew rollers 27 and 63 are changed between "left" and "right" while the conveyance direction is set at the center line.

Then, operation of the embodiment will be described.

The continuous form paper P is expanded or contracted by the heat when the full-color toner image is fixed to the continuous form paper P by the flash fixing device 52. Particularly, in a case of the flash fixing device 52 used in the embodiment, the continuous form paper P is largely expanded or contracted because the continuous form paper P is not nipped while the continuous form paper P is instantaneously heated to a high temperature in a wide range.

The arms 66 of the buffer unit 200 swing to change the position of the tension imparting roller 60 in association with the expansion or contraction of the continuous form paper P occurred in the fixing. However, the position of the detection portion 72 of the arm 66 is detected by the sensor 70, and the control unit 100 controls the number of revolutions of the sub-drive roller 61 based on the detection result such that the position of the tension imparting roller 60 is immediately located at the predetermined position. Therefore, the fluctuation in tension is suppressed in the continuous form paper P.

Specifically, when the continuous form paper P is contracted to increase the tension of the continuous form paper P at the flash fixing device 52, the tension imparting roller 60 is pressed toward the direction in which a buffer amount of the continuous form paper P is decreased (direction A in FIGS. 2 and 4A). Therefore, the arms 66 are also rotated, and the change in position of the detection portion 72 of the arm 66 is detected by the sensor 70 (see FIG. 3). The detection result is transmitted to the control unit 100. On the basis of the detection result, the control unit 100 decreases the rotational speed of the sub-drive roller 61 to move the tension imparting roller 60 toward the direction in which the buffer amount of the continuous form paper P is increased.

On the other hand, when the continuous form paper P is expanded to decrease the tension of the continuous form paper P at the flash fixing device 52, the tension imparting roller 60 is pulled toward the direction in which the buffer amount of the continuous form paper P is increased (direction B in FIGS. 2 and 4B). Therefore, the arms 66 are also rotated, and the change in position of the detection portion 72 of the arm 66 is detected by the sensor 70. The detection result is transmitted to the control unit 100. On the basis of the detection result, the control unit 100 increases the rotational speed of the sub-drive roller 61 to move the tension imparting roller 60 toward the direction in which the buffer amount of the continuous form paper P is decreased.

By repeating the above process, that is, by the rotational speed of the sub-drive roller 61 being slightly changed with respect to the drive roller 18, the continuous form paper P is conveyed such that the tension imparting roller 60 is kept at a predetermined position, i.e., the tension of the continuous form paper P is kept constant.

Accordingly, the fluctuation in tension of the continuous form paper P is suppressed at transferring of the continuous form paper P, so that the good image can be formed. Further, the continuous form paper P is stably conveyed, so that the conveyance failure can be prevented.

Further, as shown in FIG. 4A, the conveyance guide 26 including the side guide 128 is arranged at the upstream side of the drive roller 18, and the conveyance guide 62 including the side guide 129 is arranged at the downstream side of the drive roller 61. Therefore, the continuous form paper P is stably conveyed, and the fluctuation in tension is suppressed.

In the feedback conveyance, the continuous form paper P is conveyed from the sub-drive roller 61 to the image forming unit 11. That is, the continuous form paper P is biased to the side guide 129 by the skew roller 63 whose orientation is changed, and the continuous form paper P is conveyed to the image forming unit 11 at the upstream side while the skew of the continuous form paper P is corrected along the side guide 129.

Accordingly, the continuous form paper P is stably conveyed in the feedback conveyance. Further, because the position in the width direction of the continuous form paper P is not shifted in the feedback conveyance, the position in the width direction is not shifted even if the image is formed after the feedback conveyance.

The foregoing description of the embodiment of the present invention has been provided for the purposes of illustration and description. It is not intended to be exhaustive or to limit the invention to the precise forms disclosed. Obviously, many modifications and variations will be apparent to practitioners skilled in the art. The embodiment are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, the method of detecting the position of the tension imparting roller 60 (method of detecting the buffer amount) is not limited to the configuration of the embodiment. Alternatively, the position of the tension imparting roller 60 (buffer amount) may be detected by measuring the angle of the arm 66 with an encoder 700 (shown by a dashed line in FIG. 2) provided at an end portion of the rotating shaft 74.

The full-color laser printer having the colors of Y, M, C, and K is described in the embodiment. However, the printer is not limited to the four-color laser printer, but the invention can be applied to a full-color laser printer having five colors or more in which different color such as light magenta is added to the four colors. The invention can also be applied to a laser printer having three colors or less.

What is claimed is:

1. An image forming apparatus comprising:

a drive roller that nips and conveys a continuous form paper to a downstream side at a predetermined speed;

an image forming unit that is provided at the downstream side of the drive roller and transfers a toner image to the continuous form paper;

a fixing unit that is provided at the downstream side of the image forming unit and fixes the transferred toner image to the continuous form paper with heat;

a paper discharge unit provided at the image forming apparatus, that discharges the continuous form paper on which the fixed toner image fixed by the fixing unit is formed;

a sub drive roller that is provided at the downstream side of the fixing unit and at an upstream side of the paper discharge unit which discharges continuous form paper, and nips and conveys the continuous form paper, on which the toner image is fixed, to the downstream side, a rotational speed of the sub drive roller being changable;

a buffer unit that is provided between the fixing unit and the sub drive roller provided at the upstream side of the paper discharge unit, the buffer unit increasing or decreasing a buffer amount of the continuous form paper according to expansion or contraction of the continuous form paper caused by heat in the fixing unit;

a detection section that detects the buffer amount of the buffer unit; and a control section that controls the rotational speed of the sub drive roller based on the detection result of the detection section such that the buffer amount of the buffer unit is kept substantially constant.

2. An image forming apparatus according to claim 1, wherein the buffer unit that is provided at the downstream side of the fixing unit, comprises a tension imparting roller that biases the continuous form paper with a predetermined pressing force, the buffer amount being increased or decreased by movement of the tension imparting roller, the detection section detects a position of the tension imparting roller, and the control section controls the rotational speed of the sub drive roller such that the position of the tension imparting roller is kept substantially constant.

3. An image forming apparatus according to claim 1, wherein the fixing unit comprises a flash fixing device that fixes the toner image by flash light.

4. An image forming apparatus according to claim 1, wherein conveyance guides, which include a side guide on which one end portion of the continuous form paper in a width direction abuts for positioning the continuous form paper in the width direction, are provided at the upstream side of the drive roller and at the downstream side of the sub drive roller respectively.

5. An image forming apparatus according to claim 4, wherein the conveyance guide comprises a skew roller that abuts on the continuous form paper at a certain orientation with respect to a conveyance direction of the continuous form paper, and biases the continuous form paper to the side guide, and the orientation of the skew roller is changed so as to bias the continuous form paper to the side guide at a time of feedback conveyance in which the continuous form paper is conveyed in a reverse direction.

6. An image forming apparatus according to claim 2, wherein the control section decreases the rotational speed of the sub drive roller when the continuous form paper is contracted at the fixing unit, and increases the rotational speed of the sub drive roller when the continuous form paper is expanded at the fixing unit.

7. An image forming apparatus according to claim 2, wherein end portions in a shaft direction of the tension imparting roller are supported at one end portions of arm portions, the tension imparting roller being able to swing with respect to a rotating shaft provided at the other end portions of the arm portions.

8. An image forming apparatus according to claim 7, wherein the arm portion is connected to an urging member, the tension imparting roller biasing the continuous form paper with the predetermined pressing force by the urging member.

9. An image forming apparatus according to claim 7, wherein the detection section detects the position of the tension imparting roller by detecting a position of a detection portion provided at the other end portion of the arm portion.

10. An image forming apparatus according to claim 7, wherein the detection section detects the position of the tension imparting roller by detecting a rotation angle of the rotating shaft provided at the other end portions of the arm portions.

* * * * *